US005647012A

United States Patent [19]

Han

[11] Patent Number: 5,647,012

[45] Date of Patent: Jul. 8, 1997

[54] TRI-CHAMBER SPEAKER BOX

[76] Inventor: Sang Wu Han, 18533 Rio Seco Dr. #C, Rowland Heights, Calif. 91748

[21] Appl. No.: 661,019

[22] Filed: Jun. 10, 1996

[51] Int. Cl.[6] ..... H04R 25/00

[52] U.S. Cl. ..... 381/188; 381/194; 381/205; 181/156

[58] Field of Search ..... 381/24, 89, 96, 381/159, 165, 194, 195, 197, 199, 205, 188; 181/145, 152, 156, 194, 199, 151, 171, 172

[56] References Cited

U.S. PATENT DOCUMENTS

| | | | |
|---|---|---|---|
| 3,412,824 | 11/1968 | Armstrong | 181/31 |
| 3,688,864 | 9/1972 | Guss | 181/31 |
| 3,909,531 | 9/1975 | Plummer | 181/145 |
| 3,961,684 | 6/1976 | Michael | 181/143 |
| 3,962,544 | 6/1976 | Kobayashi | 181/152 |
| 4,196,790 | 4/1980 | Reams | 181/145 |
| 4,213,008 | 7/1980 | Helffrich | 181/152 |
| 4,213,515 | 7/1980 | Laupmann | 181/145 |
| 4,224,469 | 9/1980 | Karson | 181/156 |
| 4,301,889 | 11/1981 | Tralonga | 181/145 |
| 4,325,454 | 4/1982 | Homphrey | 181/144 |
| 4,437,539 | 3/1984 | Festa | 181/156 |
| 4,524,845 | 6/1985 | Perrigo | 181/152 |
| 4,843,624 | 6/1989 | Rashak | 381/88 |
| 4,860,367 | 8/1989 | Hook | 381/156 |
| 5,111,905 | 5/1992 | Rodgers | 181/152 |
| 5,147,986 | 9/1992 | Cockrum et al. | 181/145 |
| 5,327,504 | 7/1994 | Hobelsberger | 381/159 |
| 5,374,124 | 12/1994 | Edwards | 381/188 |
| 5,461,676 | 10/1995 | Hobelsberger | 381/159 |

*Primary Examiner*—Curtis Kuntz
*Assistant Examiner*—Rexford Barnie
*Attorney, Agent, or Firm*—Eugene Oak

[57] ABSTRACT

A speaker box with improved low frequency response. Three chambers of specified proportion are provided which allow vibration of both front-cone and rear-cone sound waves projected from an internally installed low frequency speaker. Housing is provided for one or more higher frequency speakers, further providing rear covers to protect the speakers from low frequency sound wave interference. Ports are also provided for rear-cone sound wave emission.

1 Claim, 4 Drawing Sheets

TRI-CHAMBER SPEAKER BOX

FIELD OF THE INVENTION

The present invention generally relates to a speaker box, particularly to a speaker box comprising three chambers and having improved low frequency response.

BACKGROUND OF THE INVENTION

It is a commonly known fact that speakers designed for low frequencies are particularly subject to distortion. While distortion is usually not a problem at low volumes, it is almost unavoidable at very high volumes. Various methods have been employed which attempt to reduce distortion in low-frequency speakers. These methods include separating the interior of low frequency speaker boxes into two separate chambers, as well as installing one or more ports with or without tubes extending into the interior of the speaker box.

There are a wide variety of speaker boxes on the market designed for home stereos. Many of these speaker boxes are specifically designed for improved low frequency response. Examples of such speaker boxes are U.S. Pat. No. 4,860,367 to Hook, disclosing a low frequency loud speaker, and U.S. Pat. No. 4,524,845 to Perrigo, disclosing a low frequency speaker enclosure.

Although these prior art have certain functional similarities to the present invention, the present invention possesses distinct advantages over the prior art which will be pointed out in more particularity in the following sections.

SUMMARY OF THE INVENTION

The present invention is a tri-chamber speaker box with improved low frequency response. The unique design of the presently invented speaker box allows sound waves produced by the internally-installed low frequency speaker to vibrate at a three different predetermined low frequencies. This is made possible by partitioning of the interior of the speaker box into three specifically proportioned chambers. Sound waves projected from the front of the speaker vibrate within one chamber while rear-cone sound waves projected from the rear of the speaker vibrate within the two remaining chambers.

As the speaker itself is vibrating, the actual movement required of the speaker to produce sound waves is diminished as the above-mentioned predetermined frequencies are occurring within the three chambers of the speaker box. Distortion is thereby decreased, and the power required by the speaker to produce sound of a given volume is also reduced. Thus, the overall efficiency of the speaker is increased, allowing a user to enjoy louder and clearer music with the same amount of power as before.

Although the present invention is specifically designed to improve low-frequency output, the presently invented speaker box also houses both a midrange speaker and a horn tweeter. The presently invented speaker box provides covers for the rear portions of these smaller speakers to block out possible interference created by the low frequency sound waves reflecting off the interior surfaces of the speaker box.

Thus, it is an object of the present invention to provide a speaker box which increases the efficiency of an internally installed low frequency speaker.

It is another object of the present invention to provide a speaker box which produces optimum low frequency response.

It is another object of the present invention to provide a speaker box with three specifically proportioned chambers.

It is another object of the present invention to provide a speaker box which greatly reduces distortion commonly found in low frequency speaker boxes.

It is another object of the present invention to accommodate a mid to high frequency speaker or speakers while protecting the rear portions of these speakers from low-frequency interference from within the speaker box.

These and other objects, advantages and novel features of the invention will become apparent from the detailed description that follows, when considered in conjunction with the accompanying drawings.

BRIEF DESCRIPTION OF THE DRAWINGS

For a better understanding of the nature of the present invention, reference should be made to the following detailed description taken in connection with the accompanying drawings wherein.

DETAILED DESCRIPTION OF THE PREFERRED EMBODIMENT

Figure 1:
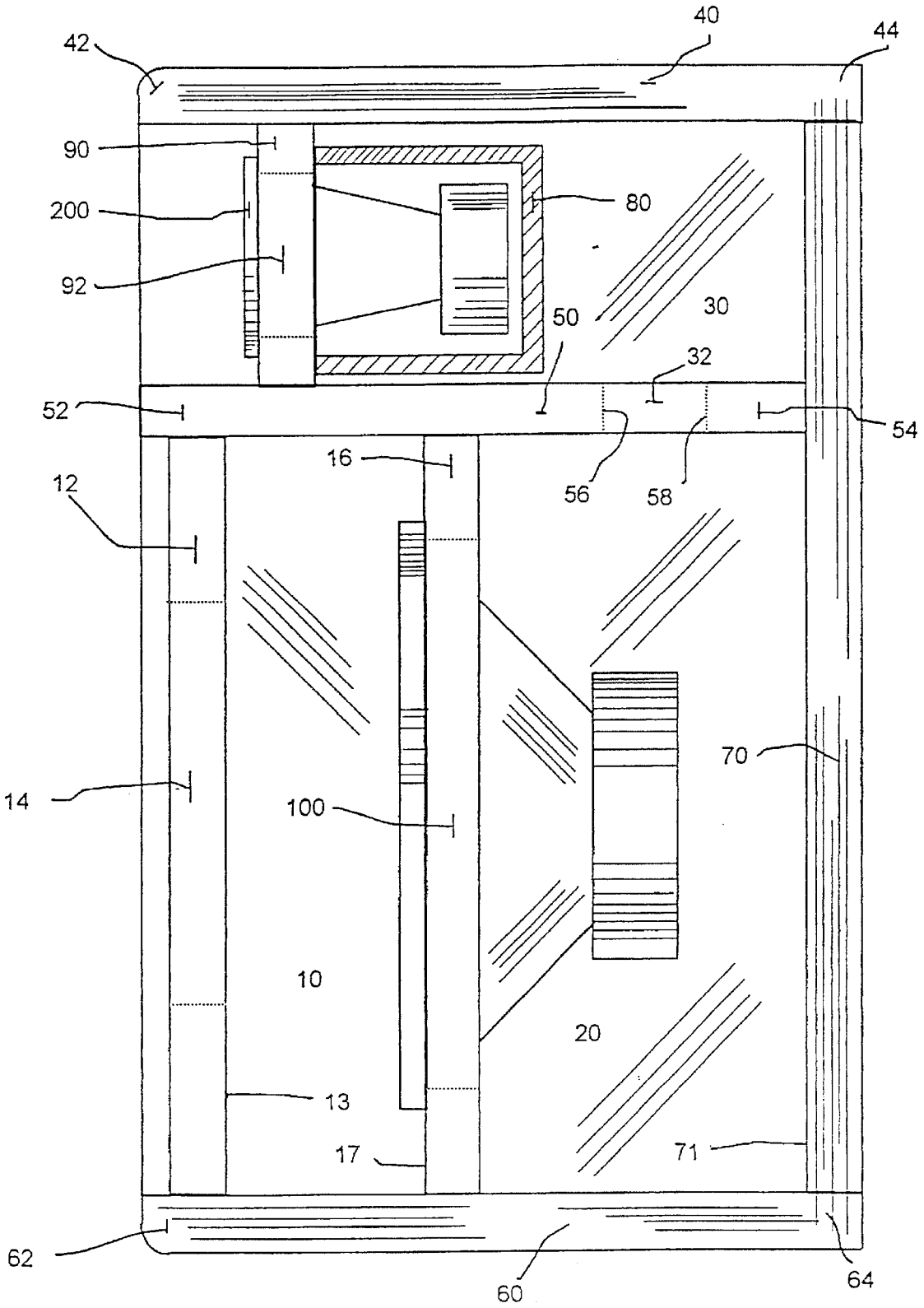
FIG. 1 is a cross-sectional side elevational view of the present invention.

Referring now to FIG. 1, the presently invented speaker box is divided into three chambers: a lower front chamber 10, lower rear chamber 20, and upper chamber 30. A horizontal middle baffle 50 forms a division separating the upper chamber 30 from the two lower chambers 10 and 20. The horizontal upper baffle 40, horizontal middle baffle 50, and horizontal lower baffle 60 each have a front edge 42, 52, and 62, respectively. These front edges 42, 52, and 62 jointly form a plane which defines the front extremity of the speaker box. Each of the horizontal baffles 40, 50, and 60 also has a rear edge 44, 54, and 64, respectively. Two of the rear edges 44 and 64 are connected by a vertical rear baffle 70. The rear edges 44 and 64 and the vertical rear baffle 70 jointly form a plane which defines the rear extremity of the speaker box. The rear edge 54 of the horizontal middle baffle 50 is connected to the front surface 71 of the vertical rear baffle 70 and extends perpendicularly forward from the vertical rear baffle 70.

Figure 2:
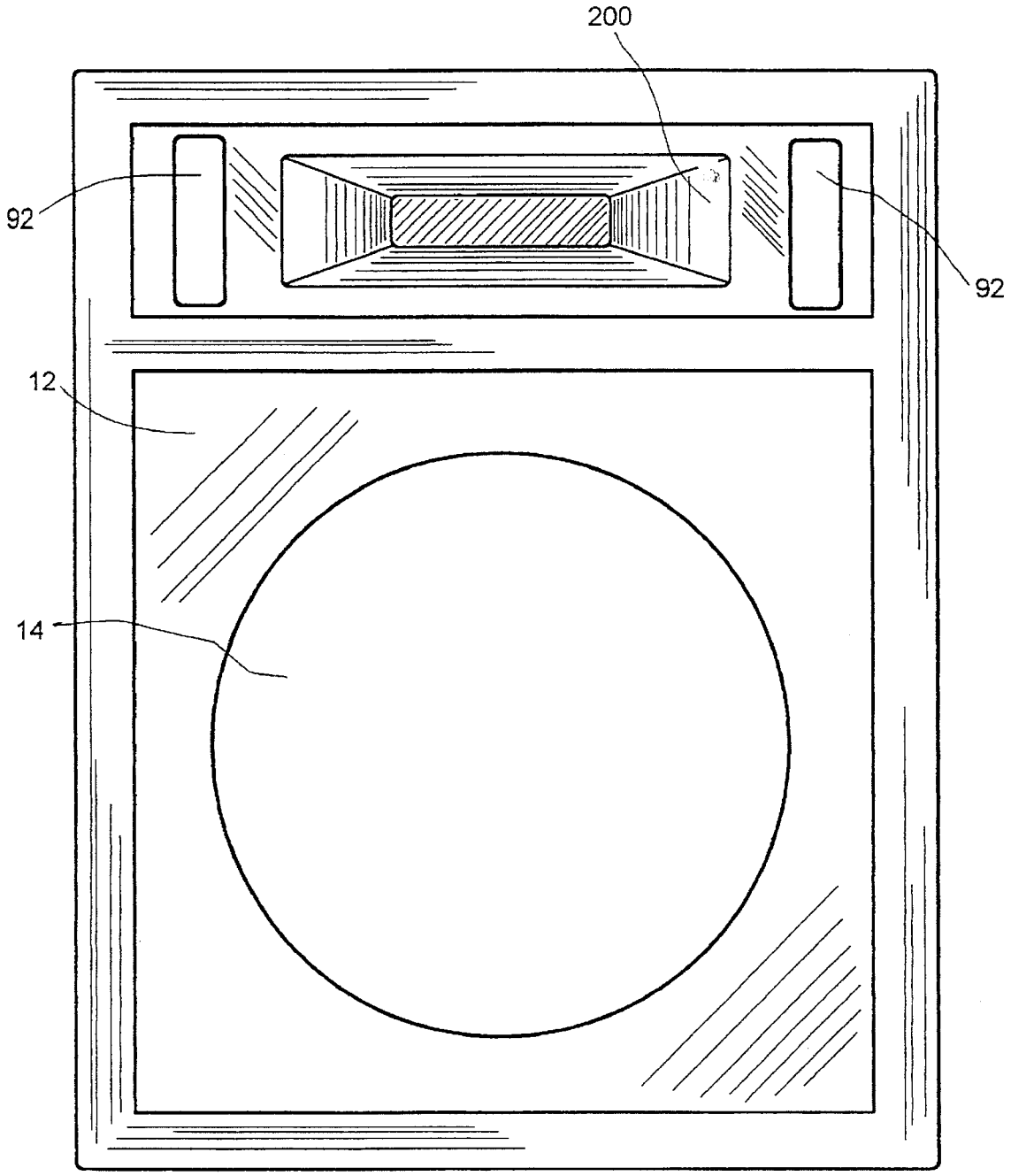
FIG. 2 is a front elevational view of the present invention.
Figure 3:
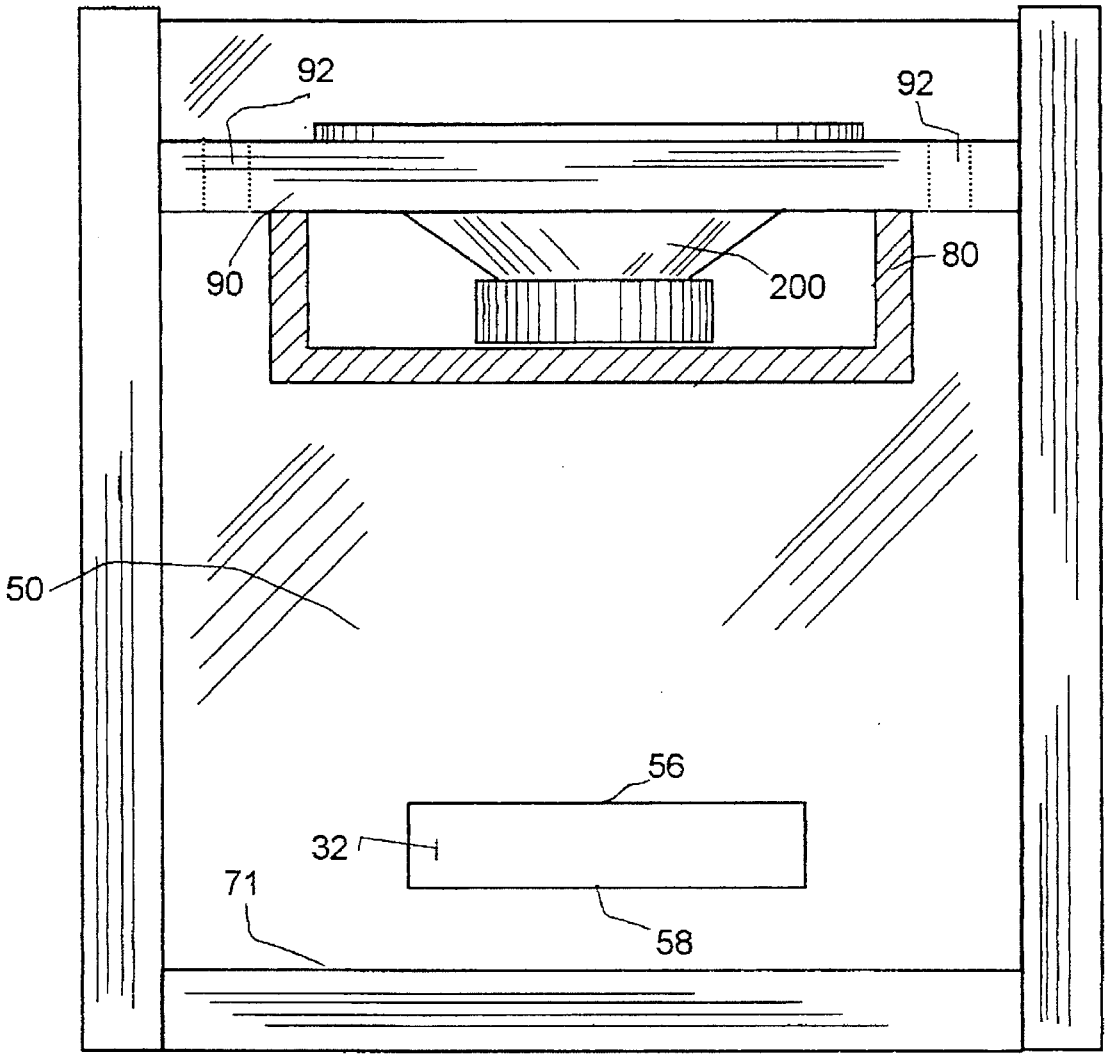
FIG. 3 is a cross-sectional top plan view of the present invention.
Figure 4:
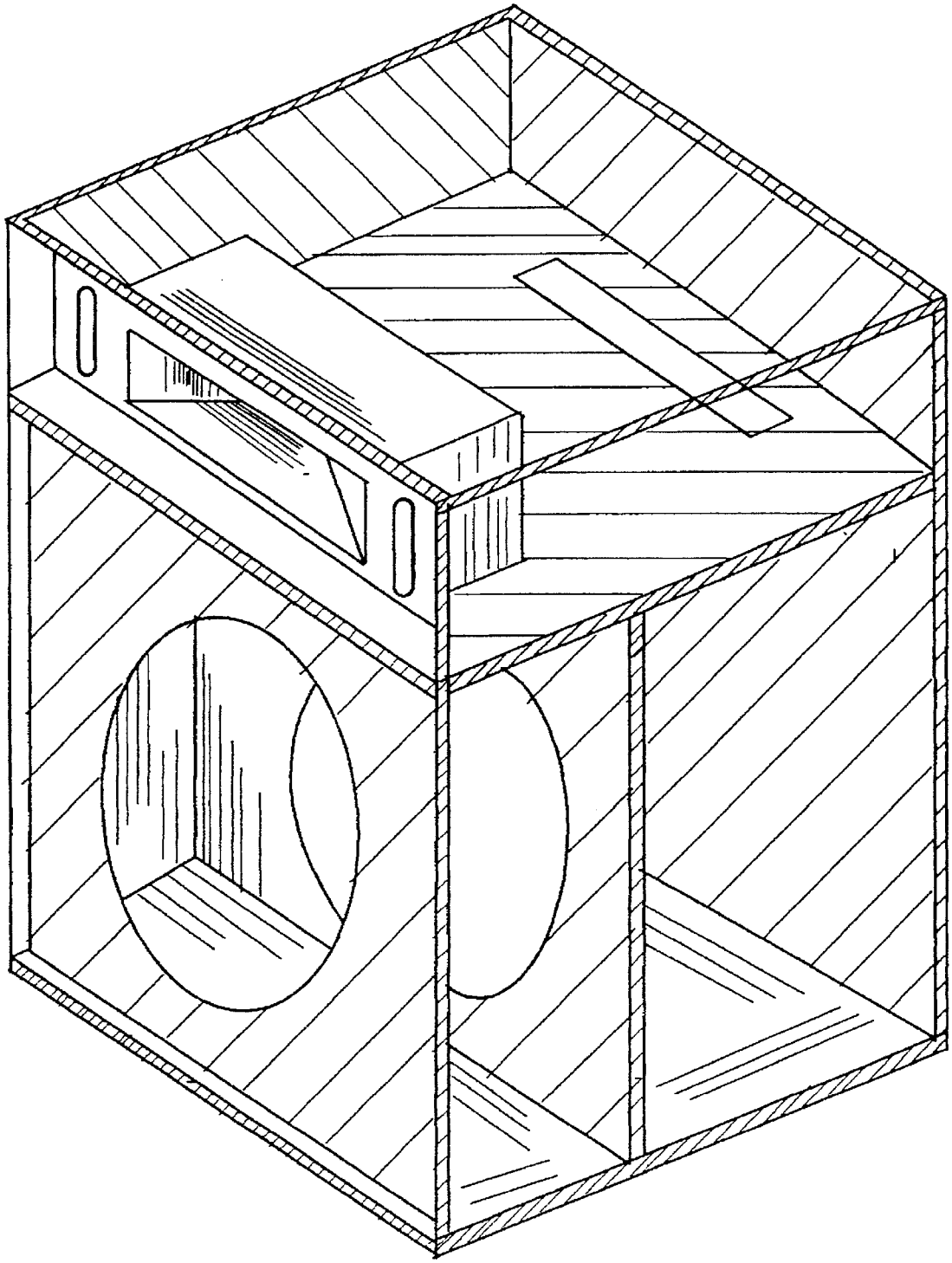
FIG. 4 is a perspective view of the present invention exposing its inner parts.

The lower front chamber 10 is bound at its front by a vertical front baffle 12 with a centrally positioned hole 14, shown more clearly in FIG. 2. The vertical front baffle 12 is slightly recessed from the front extremity of the speaker box formed by the from edges 42, 52, and 62 of the baffles 40, 50, and 60. The lower front chamber 10 is bound at its rear by a vertical middle baffle 16 with a centrally mounted low frequency speaker 100. The diameter of the centrally positioned hole 14 of the vertical from baffle 12 must be ¾ the diameter of the low frequency speaker 100 for optimum bass response. For example, if the centrally installed low frequency speaker has a diameter of twelve inches, the centrally positioned hole 14 must be nine inches.

The lower rear chamber 20 is bound at its from by the vertical middle baffle 16 with centrally mounted low frequency speaker 100. The lower rear chamber 20 is bound at its rear by the vertical rear baffle 70. The distance from the rear surface 13 of the vertical front baffle 12 to the front surface 17 of the vertical middle baffle 16 is ⅖ the distance from the rear surface 13 of the vertical front baffle 12 to the front surface 71 of the vertical rear baffle 70. The distance from the front surface 17 of the vertical middle baffle 16 to the from surface 71 of the vertical rear baffle 70 is consequently ⅗ the distance from the rear surface 13 of the vertical front baffle 12 to the front surface 71 of the vertical rear baffle 70.

The lower rear chamber 20 and upper chamber 30 are connected by a rectangular hole 32 in the horizontal middle baffle 50. The rectangular hole is positioned such that the distance from the front 56 of the rectangular hole 32 to the front surface 71 of the vertical rear baffle 70 is 3/12 (¼ ) the distance from the front edge of the horizontal middle baffle 50 to the front surface 71 of the vertical rear baffle 70. The distance from the rear 58 of the rectangular hole 32 to the front surface 71 of the vertical rear baffle 70 is 2/12 (⅙ ) the distance from the front edge 52 of the horizontal middle baffle 50 to the front surface 71 of the vertical rear baffle 70. Consequently, the distance from the front 56 of the rectangular hole 32 to the rear 58 of the rectangular hole 32 is 1/12 the distance from the front edge 52 of the horizontal middle baffle 50 to the front surface 71 of the vertical rear baffle 70.

The upper chamber 30 is bound at its rear by the vertical rear baffle 70. The upper chamber 30 is bound at its front by an upper vertical front baffle 90 with a centrally installed horn tweeter 200. A rear cover 80 is provided to prevent rear-cone sound waves from the low frequency speaker 100 from interfering with the horn tweeter 200. It should be noted that although a horn tweeter is used in the drawing, a midrange speaker can also be used either in place of or concurrently with the horn tweeter. The importance of the rear cover 80 is that it protects any high frequency speaker or speakers installed in the upper vertical front baffle 90 from low frequency interference from the rear. Ports 92 in the upper vertical front baffle 90 are provided on either side of the horn tweeter 200 for emission of rear-cone sound waves.

It should be noted that all proportions set forth above are crucial to the optimum low frequency response achieved by the present invention.

Thus, as particular frequencies are vibrating within each of the chambers 10, 20, and 30, the actual movement required of the low-frequency speaker to produce sound waves is diminished. Distortion is thereby decreased, and the power required by the speaker to produce sound of a given volume is also reduced. As a result, the overall efficiency of the low frequency speaker is increased, allowing the speaker to produce louder and clearer music with the same amount of power.

Particular features of the invention are emphasized in the claims which follow.

What is claimed is:

1. Improved low-frequency response speaker box having an upper chamber, lower front chamber, and lower rear chamber, specifically comprising:

a. a horizontal upper baffle;

b. a horizontal lower baffle;

c. a vertical rear baffle;

d. the rear edge of said horizontal upper baffle being connected to the upper edge of said vertical rear baffle and the rear edge of said horizontal lower baffle being connected to the lower edge of said vertical rear baffle;

e. a horizontal middle baffle parallel to said horizontal upper baffle and said horizontal lower baffle and extending perpendicularly from the front surface of said vertical rear baffle;

f. a vertical front baffle parallel to said vertical rear baffle, the upper edge of said vertical middle baffle contacting the lower surface of said horizontal middle baffle and the lower edge of said vertical middle baffle contacting the upper surface of said horizontal lower baffle;

g. said vertical front baffle being slightly recessed from the plane formed by the front edges of the horizontal upper baffle, horizontal middle baffle, and horizontal lower baffle;

h. a vertical middle baffle parallel to said vertical front baffle and said vertical rear baffle, the upper edge of said vertical middle baffle contacting the lower surface of said horizontal middle baffle and the lower edge of said vertical middle baffle contacting the upper surface of said horizontal lower baffle;

i. said vertical middle baffle being positioned between said vertical front baffle and said vertical rear baffle such the distance from the rear surface of said vertical front baffle to the front surface of said vertical middle baffle is ⅖ the distance from the rear surface of said vertical front baffle to the front surface of said vertical rear baffle;

j. said vertical middle baffle being positioned between said vertical front baffle and said vertical rear baffle such that the distance from the front surface of said vertical middle baffle to the front surface of said vertical rear baffle is ⅗ the distance from the rear surface of said vertical front baffle to the front surface of said vertical rear baffle;

k. said vertical middle baffle having a centrally positioned hole therethrough for mounting of a low frequency speaker;

l. said vertical front baffle having a centrally positioned hole therethrough with a diameter ¾ the diameter of the low frequency speaker installed in said vertical middle baffle;

m. said horizontal middle baffle having a rectangular hole therethrough;

n. said rectangular hole being positioned such that the distance from the front of said rectangular hole to the front surface of said vertical rear baffle is ¼ the distance from the front edge of said horizontal middle baffle to the front surface of said vertical rear baffle;

o. said rectangular hole being positioned such that the distance from the rear of said rectangular hole to the front surface of said vertical rear baffle is ⅙ the distance from the front edge of said horizontal middle baffle to the front surface of said vertical rear baffle;

p. an upper vertical front baffle having a centrally positioned opening therethrough for mounting a horn tweeter therein;

q. said upper vertical front baffle having a centrally positioned opening therethrough for mounting a midrange speaker therein;

r. said upper vertical from baffle having centrally positioned openings therethrough for mounting both a tweeter and midrange speaker therein;

s. said upper vertical front baffle having ports on either side of said opening.

* * * * *